United States Patent [19]

Kaiser et al.

[11] 4,224,613

[45] Sep. 23, 1980

[54] WARNING SYSTEM FOR PRINTING PRESSES

[75] Inventors: Werner Kaiser, Offenback-Rumpenheim; Harry Greiner, Offenbach am Main, both of Fed. Rep. of Germany

[73] Assignee: M.A.N.-ROLAND Druckmaschinen Aktiengesellschaft, Fed. Rep. of Germany

[21] Appl. No.: 965,599

[22] Filed: Dec. 1, 1978

[30] Foreign Application Priority Data

Dec. 5, 1977 [DE] Fed. Rep. of Germany ..... 2754040

[51] Int. Cl.[3] ..... G08B 19/00

[52] U.S. Cl. ..... 340/679; 340/328; 340/384 E; 340/520; 340/524

[58] Field of Search ..... 340/328, 329, 384 E, 340/519, 520, 521, 524, 673, 674, 679

[56] References Cited

U.S. PATENT DOCUMENTS

| | | | |
|---|---|---|---|
| 1,795,316 | 3/1931 | Seeger | 340/679 X |
| 3,287,975 | 11/1966 | Mason et al. | 340/384 E |
| 3,298,010 | 1/1967 | Debosq et al. | 340/679 X |
| 3,978,479 | 8/1976 | Schmitz | 340/519 |
| 3,995,492 | 12/1976 | Clynes | 340/384 E X |
| 4,015,237 | 5/1977 | Takatani et al. | 340/519 X |

*Primary Examiner*—John W. Caldwell, Sr.

*Assistant Examiner*—Joseph E. Nowicki

*Attorney, Agent, or Firm*—Leydig, Voit, Osann, Mayer & Holt, Ltd.

[57] ABSTRACT

A warning system for a printing press to warn the operator upon the exceeding, or departure from, a desired set of running conditions which includes a plurality of remote condition transducers which, in the simplest form of the invention, are in the form of switches. Coupled to the transducers are respective signal generators each of which generates an acoustic signal which has a distinctive quality as compared to all of the other acoustic signals. A loudspeaker common to all of the signal generators is audible at the control station. The distinctiveness of the signal serves to promptly inform the operator which of the running conditions has been exceeded so that corrective action may be taken. In a second embodiment of the invention the transducers produce output control signals which vary in magnitude with the condition, and the corresponding acoustic signal generator produces a signal having a distinctive first quality when the control signal exceeds a threshold level. In addition, each signal generator is made responsive to the magnitude of the control signal for imparting to the acoustic signal a distinctive second quality to a degree which depends upon the departure of the control signal from the threshold level and which is thereby indicative of the degree of urgency.

7 Claims, 11 Drawing Figures

OSC
SG1
SG2
SG3
SG4
SG5
AMP
REC
MIC
OIL LEVEL TRANS-DUCER
TEMP. TRANS-DUCER
ALIGN-MENT TRANS.
SHEET FEED TRANS.
DELIVERY TRANS-DUCER
RESET

SIGNAL TO PITCH TRANSDUCER
ENCODER
OSC.
SG3
FROM 112
FROM 133-1

OIL LEVEL TRANS-DUCER
TEMP. TRANS-DUCER
ALIGN-MENT TRANS.
SHEET FEED TRANS.
DELIVERY TRANS-DUCER
AMP
REC
MIC
SG1
SG2
SG3
SG4
SG5
Oil Level Transducer Temperature Transducer Alignment Transducer Delivery Transducer
Sheet Feed Transducer

WARNING SYSTEM FOR PRINTING PRESSES

Successful operation of a sheet-fed printing press over a long press run requires that a specified set of running conditions remain within normal bounds. For example, printed sheets must be fed and delivered in unbroken series, each sheet must be kept in alignment and register during the printing operation, the temperature in the various parts of the device must remain at a safe level and lubrication must be adequate. Various detectors have been used on presses in the past to monitor selected running conditions and to sound an alarm when the condition is departed from. However, it has been customary to sound an audible warning signal only in the neighborhood of the measuring point. Because of the size of a modern production press and the general noise level in the press room it frequently happens that such warning signal is not heard by the operator at the operating station; nor is it possible as a practical matter to increase the loudness of the signal to the point where the operator is sure to hear it. In addition, confusion is caused by the fact that presses in a large shop may be closely side by side, making it difficult to determine which press requires attention. Then, too, when a single press is equipped with a number of acoustic warning devices, it is difficult to distinguish between them, and even where the operator is able to distinguish which press functions are involved, the signals give no idea of priority or degree or urgency. While the element of doubt as to location may be resolved by use of remotely actuated signal lights, such lights have the disadvantage that the operator must be looking at them--they do not perform their warning and informative function when the operator has turned his back or is engaged in maintenance or adjustment of the press.

Accordingly, it is an object of the present invention to provide a warning system for a printing press which sounds an acoustic warning when any one of a given set of running conditions is exceeded or departed from, the acoustic signal corresponding to a given function or condition having a distinctive quality as compared to all of the other acoustic signals so as to promptly inform the operator at the control station which of the set of monitored conditions has been exceeded or departed from so that immediate corrective action may be taken.

It is an object of the invention, more specifically, to monitor a set of running conditions by a loudspeaker audible in the general neighborhood of the press control station which denotes, by reason of the special quality of the signal, which of the press functions or conditions requires corrective action. For example each monitoring transducer may produce at the loudspeaker an acoustic signal having a unique quality in terms of tone, repetition rate, encoding or the like.

It is another object of the present invention to provide an acoustic warning system for monitoring a plurality of press conditions or functions in which the exceeding or departure of the condition from a desired level produces a distinctive audible signal to promptly inform the operator which press function is involved and in which the sounding of one signal temporarily disables the sounding of all of the other warning signals, thereby insuring that the operator may clearly recognize the signal being given.

It is a related object of the invention, in one of its aspects, to monitor a set of running conditions having a series of priority and in which the sounding of a signal corresponding to any one of the conditions serves to disable only those other signals having lesser priority, permitting any signal of higher priority to "take over" the warning function thereby to avoid confusion and to insure prompt reporting of a malfunction of an urgent nature.

It is a still further object of the invention in one of its aspects to provide a warning system in which each acoustic warning signal contains two types of information, namely, identification of the condition or function requiring the corrective action and the degree of urgency of the corrective action. For example, the signal may be encoded to denote a particular condition or function and may vary in pitch to provide indication of urgency.

In general it is an object to provide a warning system which is highly reliable, which reduces the strain upon the operator of running a large and expensive press, which enables the press to be safely run by relatively inexperienced personnel, and which is readily expandible to include any desired number of conditions or functions.

Other objects and advantages of the invention will become apparent upon reading the attached detailed description and upon reference to the drawings in which.

Figures 1, 2, 2A, 2B, 2C:
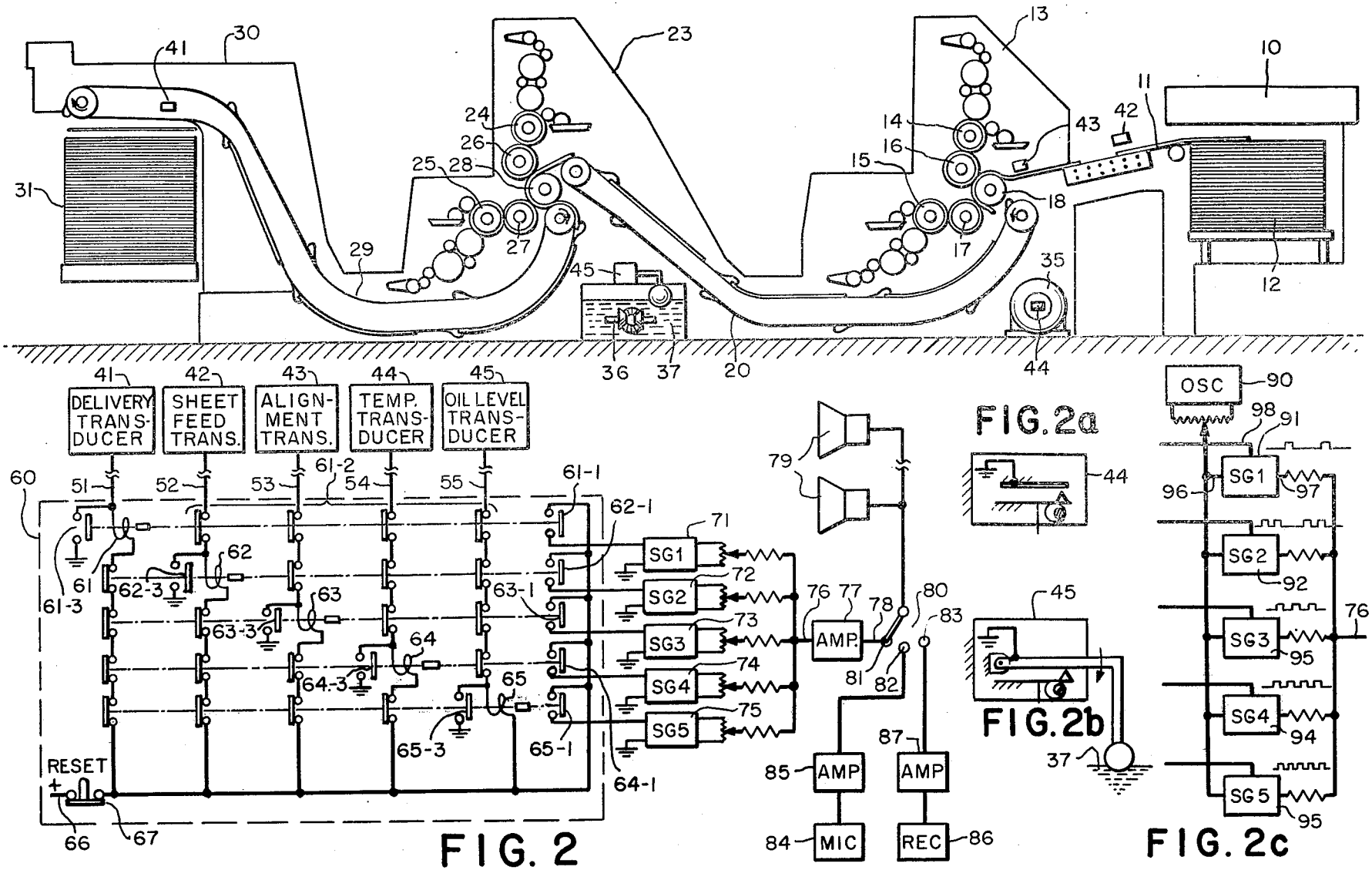
FIG. 1 is an elevational view of a typical four-color sheet-fed press to which the invention has been applied.
FIG. 2 is a schematic diagram showing a simplified warning system actuated by a plurality of transducers in the form of switches.

FIG. 2*a* shows one form of adjustable temperature switch.

FIG. 2*b* shows one form of adjustable float switch.

FIG. 2*c* shows a modification of FIG. 2 utilizing encoders fed from a common oscillator.

Figures 3, 3A, 3B, 3C, 3D, 4:
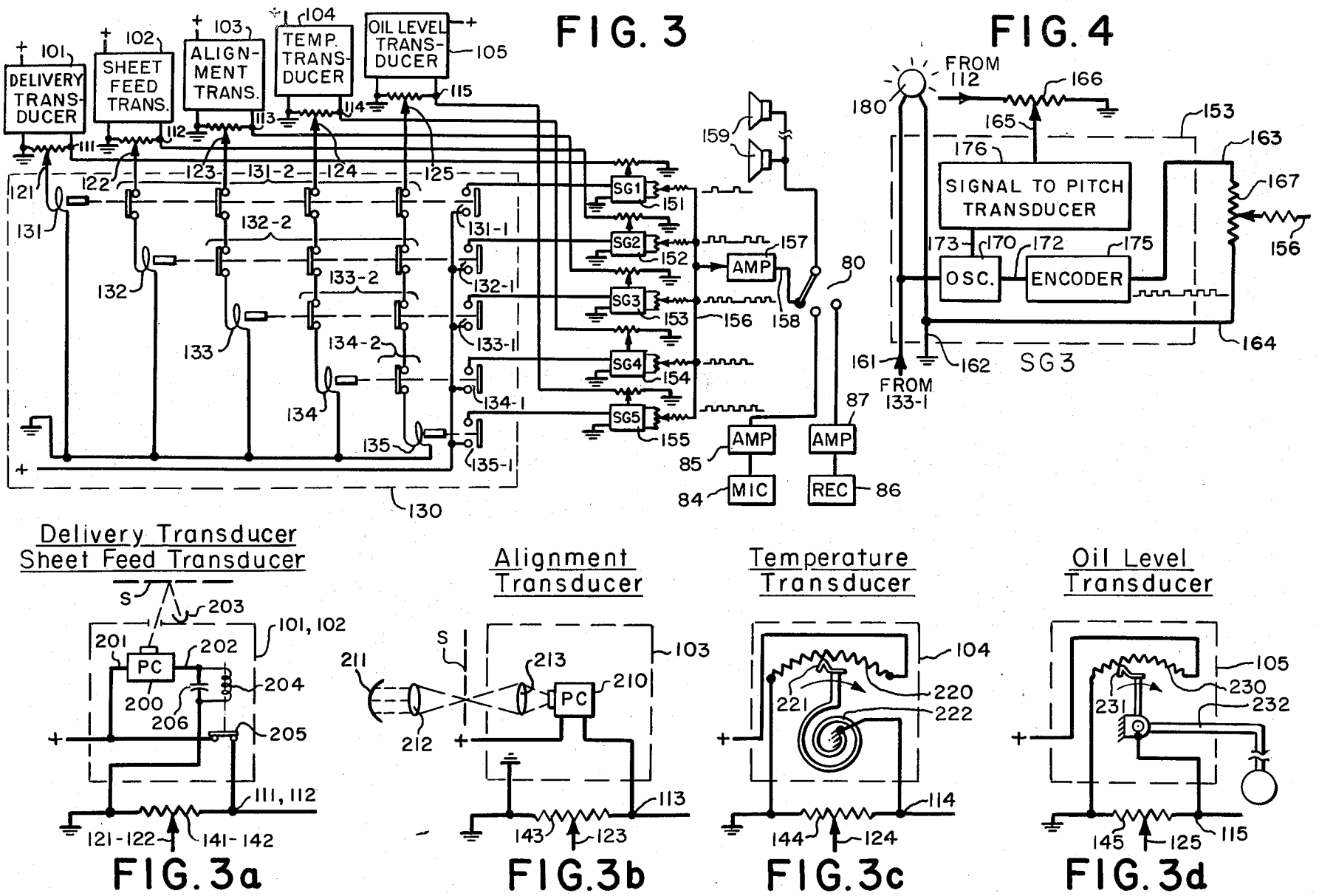

FIG. 3 shows a further modification of the invention in which running conditions are arranged in a predetermined series of priority and which permits any signal of higher priority to "take over" the alarm function and including, in addition, indication of degree of urgency.

FIGS. 3*a*–3*d* show, in simplified form, transducers of the type employed in FIG. 3.

FIG. 4 illustrates a typical signal generator of the type employed in FIG. 3.

While the invention has been described in connection with certain preferred embodiments, it will be understood that we do not intend to be limited to the particular embodiments shown but intend, on the contrary, to cover the various alternative and equivalent constructions included within the spirit and scope of the appended claims.

A sheet-fed press to which the invention is applicable is set forth in FIG. 1. The press employs a feeder 10 including a feed table 11 for feeding sheets from a pile 12 to a press unit 13. The press unit includes plate cylinders 14, 15 having respective blanket cylinders 16, 17 which cooperate with a single impression cylinder 18 for printing of two separate colors. The sheet is then transferred by a conveyor 20 to a second press unit 23 having plate cylinders 24, 25 and blanket cylinders 26, 27 cooperating with an impression cylinder 28 for application of the third and fourth colors. The printed sheet is then conveyed by a conveyor 29 to a delivery 30 where the sheets are deposited one by one on a delivery pile 31. The various portions of the press are driven in synchronized fashion by a drive motor 35 through gearing, a portion of which is shown at 36 submerged in a body of oil 37.

In carrying out the invention a plurality of transducers, i.e., detectors, are employed at strategic points in the press to signal any malfunction: Thus to insure that printed sheets arrive at the delivery in unbroken series, and for signaling a malfunction when the series is interrupted, a delivery transducer 41 is used. Similarly to insure that sheets are being fed in an unbroken series across the feed table, a feed transducer 42 is used, the nature of the devices 41, 42 to be discussed in connection with FIG. 3*a*. To insure that the sheets are being fed in proper alignment, an alignment transducer 43 is employed, the nature of such device to be explained in connection with FIG. 3*b*. To insure that the motor is running at a normal temperature a temperature transducer 44 is used which, as shown in FIG. 2*a*, may be in the form of an adjustable bimetallic switch. Finally, to insure that the oil is at a safe running level, an oil level transducer 45 embodying an adjustable float switch, as shown in FIG. 2*b*, monitors the body of oil 37.

In accordance with the present invention the transducers are all constructed and arranged to produce an output control signal when the monitored condition is exceeded, or departed from, with each of the transducers being coupled to respective signal generators for generating an acoustic signal which has a distinctive quality, a loudspeaker being coupled, in common, to all of the signal generators and audible at at least the control station, with the distinctive quality of the signal serving to promptly inform the press operator which of the running conditions requires corrective action.

For this purpose the lines 51–55 inclusive which lead from the transducers all feed into a control panel 60 having respective relays 61–65 having normally open contacts 61-1 to 65-1. The contacts, which are energized from a suitable voltage source 66, through a reset switch 67, serve to control respective signal generators 71–75, all of which are connected to a common bus 76 feeding an amplifier 77 having an output terminal 78 feeding one or more loudspeakers 79 in the neighborhood of the control station. In accordance with the invention all of the signal generators, upon selective energization, produce output signals having a distinctive quality. For example in the simplest aspect of the present invention the signal generators produce signals of different tones or pitch, or different repetition rate, so that the operator, upon hearing the signal emanating from the loudspeakers is promptly advised as to which function or condition is tending to malfunction requiring corrective action.

In accordance with one of the features of the present invention the relays 61–65 are interlocked with one another so that when one alarm signal is sounded other alarm signals are temporarily disabled. Thus each of the relays is provided with a set of four normally closed contacts, indicated collectively at 61-2, which are in series with the input lines of feeding the companion relays. If, for example, the delivery transducer 41 should signal a break in the arrival frequence at the delivery, its closure would, by opening of all of the contacts 61-2, thereby disable all of the other relays 62–65. This insures against the confusion of identification which might otherwise exist if two malfunctions occurred at about the same time.

As a further feature of the control panel, each of the relays is equipped with a set of normally open "sealing" contacts 61-3 to 65-3 inclusive so that even a momentary signal from the transducer is effective to close the relay and to keep it closed until intentionally reset by pressing the reset button 67 in series with the supply line 66.

If desired, the same loudspeakers 79 may be coupled selectively to a microphone or sound reproduction unit. Thus there is interposed in the circuit a three-way switch 80 having a normally closed contact 81 and elective contacts 82, 83, the contact 82 being used to connect a microphone 84 having an amplifier 85, and the contact 83 being coupled to a sound reproduction unit, or recorder, 86 having an amplifier 87.

In accordance with one form of the present invention the signal generators in the diagram FIG. 2 may be energized by a common oscillator 90 and may be in the form of encoding devices 91–95 having input, output and control terminals which, in the case of the device 91, taken as representative, are indicated at 96, 97 and 98, respectively. Each of the encoding devices 91–95 is so constructed as to, upon energization, break up the signal from the oscillator 90 into pulsed code groups applied repetitively to the output terminal 76 and which may, for convenience, have the wave forms illustrated in FIG. 2*c* in which a repeated single impulse denotes the first transducer, a double impulse denotes the second, a triple impulse the third, etc. The use of coded impulses, as described, has the advantage that recognition is assured even though the press operator may not be capable of distinguishing other signal qualities such as pitch or chopping rate.

As a significant feature of the present invention, means are provided for further modifying an acoustic alarm signal so that in addition to having a first, for example, coded, quality, it has in addition a distinctive second quality to a degree which depends upon the amount that the control signal exceeds a threshold level and which is thereby indicative of the degree of urgency. Such a system is shown in FIG. 3 in which transducers, having functions corresponding to those of FIG. 2, are indicated at 101–105. Mention will be made in due course of the specific construction of the different transducers, but it will suffice for the present to say that each transducer, exclusive of the delivery and sheet fed transducers, is constructed to produce an output signal which varies in accordance with the function or condition being measured. Thus the transducers 101–105 have output terminals 111–115 as well as "threshold" output terminals 121–125, the latter feeding into a control panel 130 having relays 131–135 controlling respective normally-open contacts 131-1 to 135-1, similar to contacts 61-1 to 65-1.

For setting the threshold level of the control signal, that is, the level of voltage at which each relay will pick up, potentiometers 141–145 are interposed at the outputs of the respective transducers (see FIGS. 3*a*–3*d*).

The normally open contacts 131-1 to 135-1 associated with the respective relays serve to control the operation of respective signal generators 151–155. The latter all feed a common signal bus 156 connected to an amplifier 157 having an output terminal 158 feeding one or more loudspeakers 159 which are audible at each part of the press where the operator may be and at least at the press control station.

In accordance with one of the features of the present invention the transducers are arranged in the order of priority and the relays 131–135 are provided with interlocked disabling contacts so that a control signal from one of the transducers is effective to temporarily disable the signal generators corresponding to the conditions of lesser priority so that when two control signals are produced at the same time, only the acoustic signal corresponding to the condition of higher priority is sounded. Placed first in priority is the delivery of the product in continuous sequence. Second in priority is the passage of sheets across the feed table. Third in priority is the transverse alignment of such sheets with respect to the feeding means. Fourth in priority is the temperature of a motor or similar driving component, while fifth in priority is the level of lubricating fluid.

Thus, referring first to the relay 131, it has auxiliary normally closed disabling contacts 131-2 in series with the relays 132–135 of lesser priority. Similarly the relay 132 has disabling contacts 132-2, the relay 133 has disabling contacts 133-2 and the relay 134 has disabling contacts 134-2, all interposed in the input lines of relays of successively lower priority.

As a result of the priority circuitry, should the oil level monitored by transducer 105 fall below a safe level, relay 135 would close, resulting in energization of the fifth signal generator 155 by reason of contact 135-1, resulting in the sounding of the fifth warning signal by the loudspeakers 159. However, should there shortly thereafter be an increase in motor temperature, closure of relay 134 would not only energize the fourth signal generator 154, via contacts 134-1, but opening of normally closed contact 134-2 would serve, at the same time, to drop out relay 135 which is in series therewith to disable the fifth, or oil level, warning signal. The same priority is established up the scale to the first input line 121, where triggering of the delivery transducer 101 results in the closure of relay 131 which sounds the first, or delivery warning, signal, at the same time dropping out any of the other relays corresponding to conditions of lesser priority. This insures that the most significant one of a number of more or less simultaneous malfunctions will be clearly and exclusively signaled for correction on a priority basis.

As stated, it is one of the features of the circuit shown in FIG. 3 that two types of information are provided by each signal sounded by the loudspeakers, namely, the identification of the malfunction and the degree of urgency, which are signaled by separate distinctive qualities embodied in the signal. Two separate distinctive qualities may be embodied in the signal by employing signal generators of the type set forth in FIG. 4, the signal generator 153, associated with the alignment transducer 103, being taken as representative. Such signal generator is preferably provided with a pair of input terminals 161–162, a pair of output terminals 163, 164 and a pitch control terminal 165. The latter is connected to a potentiometer 166 which is fed from terminal 113 of the transducer 103. Bridging the output terminals is an output potentiometer 167.

Attention may be given, first of all, to the means for determining the first, or identifying, quality of the signal. The signal is generated by an oscillator 170 having a control terminal 171, an output terminal 172 and a pitch control terminal 173. Connected in series with the output terminal 172 is an encoder 175 which breaks up the oscillator signal into successive repetitive groups of coded impulses. Thus in the case of the third transducer the distinguishing code group consists of three impulses to produce three "beeps" in quick succession from the loudspeakers, with continuous repetition, to signal to the operator that it is the third or "alignment" function which requires attention. An encoder 175 capable of producing successive repetitive code groups of three impulses or, indeed, any desired number of impulses (in the present instance from 1 to 5 corresponding to the illustrated waveforms) is a matter well within the skill of the art.

For controlling the pitch of the output signal fed into the encoder, a signal-to-pitch transducer 176 is interposed between the signal generator control terminal 165 and the oscillator control terminal 173. Such transducer is also a matter well within the skill of the art; in its simplest aspect the oscillator may be a relaxation oscillator where frequency depends upon the effective resistance at the output circuit of transducer 176 which varies in accordance with the voltage at the input terminal 165. Thus an increase in control voltage causes the frequency of the acoustic signal projected at the loudspeakers to change, desirably in the upward direction, in accordance with the degree of the control signal from the transducer 103; in other words, the more the sheet is out of transverse alignment, the higher and more insistent will be the pitch of the signal and the more urgent, therefore, the call for correction. For convenience, the pitch or urgency transducer signal may be considered, and referred to, the "carrier" and the coded transducer identification signal may be referred to as the "modulation envelope" or wave form.

While "sealing" contacts have been omitted from the circuit of FIG. 3 for the sake of simplicity, it will be apparent that contacts functionally equivalent to the contacts 61-3 to 65-3 (of FIG. 2) may be incorporated as a matter of choice. Alternatively, to inhibit dropout, each relay, and particularly the relays 131, 132 may be shunted by a capacitor. Also if desired, the signal generator 153, and the other signal generators as well, may be provided with individual indicator lamps as indicated at 180 thereby providing visual, as well as audible, identification of the malfunction.

Simply for the purpose of completeness, mention may be made of typical transducer circuits which may be employed in the practice of the present invention. Thus, referring first of all to the delivery and sheet feed transducers, 101, 102, a simplified construction is set forth in FIG. 3*a* where the passing sheet is indicated at S. The device includes a photocell 200 having terminals 201, 202 and which is placed in the reflected path of light emanating from a source 203 on the same side of the sheet. The output from the photocell serves to close a relay 204 having a set of normally closed contacts 205. Arranged in parallel with the relay coil is a capacitor 206 which inhibits drop-out of the relay during the gap between successive sheets. Accordingly, as long as sheets flow by in a steady stream, either at the delivery or at the feed table, the contacts 205 are held open and no control signal exists at the output terminals 111 (or 112) and 121 (or 122).

The transducer 103 associated with the alignment function is not simply an on-off type of device but one which produces a signal which varies directly in accordance with the degree of misalignment. The device includes a photocell 210 having an associated light source 211, a collimating lens 212 and a focusing lens 213. The output potentiometer 143 is adjusted so that threshold voltage at potentiometer terminal 123 sufficient to pick up the relay 133, is produced as alignment just begins to depart from the region of tolerance. This closes the relay, causing a signal to appear at the output of signal generator 153 in the form of coded groups of three impulses which are sounded by the loudspeakers.

In the event that there is substantial misalignment, this will produce an increase in voltage at terminal 113 of the transducer 103, with a corresponding increase at control terminal 165 of the signal generator 153 (FIG. 4) resulting in an increase in pitch of the oscillator 170, causing the coded groups of impulses to become of higher and more insistent pitch. This notifies the operator that alignment of the transported sheets requires correction on an urgent basis.

Referring next to the temperature transducer 104 (FIG. 3*c*), this transducer, simply for the sake of easy understanding, may consist of a resistance element 220 having a wiper 221 which is positioned in accordance with a thermostatic bimetal 222. The potentiometer 144 is adjusted so that the voltage appearing at its wiper 124 is below the threshold level as long as the temperature is within a safe range. However, any increase in temperature above this level produces clockwise rotation of the wiper with an increase in voltage at terminals 124, 114 energizing the relay 134 and causing a distinctive signal, in groups of four coded pulses, to emanate from the loudspeakers. The signal will be sounded at a pitch which is dependent upon the voltage existing at terminal 114, the higher the temperature the higher and more insistent the pitch.

Finally, turning to transducer 105 for monitoring oil level, it includes a resistance element 230 having a wiper 231 connected to a linkage 232 leading to the float or similar level transmitter. The functions are analogous to those described in connection with the transducer 104. The result upon reaching a low threshold level of oil is to produce closure of relay 135, actuation of the fifth signal generator 155 to produce output pulses in coded groups of five, and with the signal at terminal 115 determining the pitch of the alarm signal, thereby indicating how close the oil level is to the danger point.

While magnetic relays have been used in the exemplary circuitry, this has been done for easy understanding of the invention and equivalent solid state relay circuitry may be substituted without departing from the invention. While an affirmative voltage has been employed as a control signal, particularly in connection with FIG. 2, the term "control signal" is intended to be a general term and may be denoted by absence, instead of presence, of voltage. Similarly the term "transducer" is a general term including within its scope any device of either the on-off or progressive type for producing a control signal in accordance with the condition or function being monitored. The term "signal generator" used herein is a general term to denote any device for producing an audible signal having at least one distinctive and recognizable quality to distinguish it from the other signals produced by the device, even though portions of the signal generator may be employed on a sharing basis. For example, where a signal generator is based upon a common oscillator such as an oscillator of the RC or relaxation type, in which the frequency is changed by changing the circuit resistance, the resistor plus the remaining portions of the oscillator shall, together, be considered a signal generator. Also the term "control station" is a general term including not only the position adjacent the press controls but any position where an operator is normally within ear-shot of the loudspeakers during operation of the press.

While five typical press conditions, or functions, have been taken as representative for the purpose of describing the invention, it will be understood that the invention is not limited thereto and one skilled in the art will find it an easy matter to extend the circuitry, using the present teachings, to cover any desired number of points of possible malfunction. Indeed, the per-function economy of the present system makes practical, for the first time, the monitoring of functions which have previously gone un-monitored as, for example, the temperature of individual press bearings, the level and feed rate of ink and dampening fluid, registry of impression, jamming at various points, and the like.

It will be apparent that the invention has amply fulfilled its objects. Upon any exceeding or departure of a function or condition, denoting a present or incipient malfunction, a signal sounds having a distinctive quality which immediately denotes to the operator the element requiring corrective action. It is an easy matter for the operator, in identifying the function, to take the further mental step of deciding whether the condition is such as to require shut-down of the press. For example where a sheet fails to feed across the feed table, resulting in a similar hiatus at the delivery, this can be overlooked unless the condition persists, and the press may be kept running. Similarly, it is not necessary to shut down a press simply because the alignment alarm signal sounds, since in most cases a touch-up adjustment in alignment can be made while keeping the press in operation. Also, overheating of the drive motor or other temperature-monitored element may, after an alarm sounds, simply be watched carefully, with corrective action being deferred until the end of the press run. With respect to the addition of lubricant, the lubricant may be brought up to level while the press is still in operation or this, too, can be deferred until the end of the run. However, if the delivery alarm should sound without being preceded by the feed table alarm, indicating that a sheet is loose in the press, the operator may well wish to hit the stop button to forestall a possible jamming situation. Thus it is one of the functions of the present warning system not only to warn the pressman promptly and audibly of any potentially dangerous condition of which he should be aware but to assist him to make that value judgment required in a decision as to whether to allow the press to continue to run or to shut it down. As a result, using the present warning system, unnecessary, time-consuming and expensive shut-downs may be safely avoided.

Where the transducers of FIGS. 3*a*–3*d* are used in the system of FIG. 2, it will be understood that the applied voltage should be modified so that departure from a desired running condition results in the grounding of the output terminals 121–125 instead of application of positive voltage thereto, a difference which is well illustrated by comparing FIG. 2*a* with FIG. 3*c*.

What we claim is:

1. A warning system for a printing press having a control station and designed for operation under a given set of simultaneously desired running conditions comprising, in combination, a plurality of remote condition transducers responsive to a respective condition and each having means for producing an output control signal when its condition is departed from, a plurality of acoustic signal generators coupled to the respective transducers for energization by a control signal therefrom, each of the signal generators including means for generating an acoustic signal which has distinctive quality as compared to all of the other acoustic signals, and common loudspeaker means coupled to all of the signal generators and located in the neighborhood of the control station for sounding an acoustic signal from an energized one of the signal generators, the distinctive quality of the signal serving to promptly inform the operator of the press which of the running conditions has been departed from so that corrective action may be taken.

2. The combination as claimed in claim 1 in which each transducer has means responsive to the output control signal produced thereby for temporarily disabling other ones of the transducers and their corresponding signal generators.

3. A warning system for a printing press having a control station and designed for operation under a given set of simultaneously desired running conditions having a series of priority comprising, in combination, a plurality of remote condition transducers responsive to respective conditions and each having means for producing an output control signal when its condition is departed from, a plurality of acoustic signal generators coupled to the respective transducers for energization by a control signal therefrom, each of the signal generators including means for generating an acoustic signal which is distinctive as compared to all of the other acoustic signals, common loudspeaker means coupled to all of the signal generators and located in the neighborhood of the control station for sounding the acoustic signal from an energized one of the signal generators, the distinctive quality of the signal serving to promptly inform the operator of the press which of the running conditions has been departed from, means responsive to the existence of a control signal from one of the transducers for temporarily disabling the signal generators corresponding to the conditions of lesser priority so that when two control signals are produced at the same time, only the acoustic signal corresponding to the condition of higher priority is sounded.

4. The combination as claimed in claim 1 or claim 3 in which each of the signal generators produces an acoustic signal of different frequency.

5. The combination as claimed in claim 1 or claim 3 in which each of the signal generators produces an acoustic signal having a distinctively different modulation envelope.

6. A warning system for a printing press having a control station and designed for operation under a given set of simultaneously desired running conditions comprising, in combination, a plurality of remote condition transducers responsive to a respective condition and each having means for producing an output control signal which varies with the condition, a plurality of acoustic signal generators coupled to the respective transducers, threshold means for energizing an acoustic signal generator when the associated transducer produces a control signal above a threshold level indicative that a desired running condition has been departed from, each of the signal generators including means for generating an acoustic signal which has a distinctive first quality as compared to all of the other acoustic signals, common loudspeaker means coupled to all of the signal generators and located in the neighborhood of the control station for sounding an acoustic signal from an energized one of the signal generators, the distinctive first quality of the signal serving to promptly inform the operator of the press which of the running conditions has been departed from, and means associated with each signal generator and responsive to the magnitude of the associated control signal for imparting to the corresponding acoustic signal a distinctive second quality to a degree which depends upon the amount that the control signal departs from the threshold level and which is thereby indicative of the degree of urgency of corrective action.

7. The combination as claimed in claim 6 in which the distinctive first quality is the modulation envelope of the signal and the distinctive second quality is a variation in the carrier frequency of the signal.

* * * * *